US010502082B2

(12) United States Patent
Quennehen et al.

(10) Patent No.: US 10,502,082 B2
(45) Date of Patent: Dec. 10, 2019

(54) TURBINE RING ASSEMBLY

(71) Applicant: SAFRAN AIRCRAFT ENGINES, Paris (FR)

(72) Inventors: Lucien Henri Jacques Quennehen, Paris (FR); Sébastien Serge Francis Congratel, La Brosse Montceaux (FR); Clément Jean Pierre Duffau, Paris (FR); Nicolas Paul Tableau, Paris (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 236 days.

(21) Appl. No.: 15/680,465

(22) Filed: Aug. 18, 2017

(65) Prior Publication Data

US 2018/0051581 A1 Feb. 22, 2018

(30) Foreign Application Priority Data

Aug. 19, 2016 (FR) ..... 16 57822

(51) Int. Cl.
*F01D 11/08* (2006.01)
*F01D 25/00* (2006.01)
*F01D 25/24* (2006.01)

(52) U.S. Cl.
CPC ..... *F01D 11/08* (2013.01); *F01D 25/005* (2013.01); *F01D 25/246* (2013.01); (Continued)

(58) Field of Classification Search
CPC ..... F01D 11/08; F01D 25/246; F01D 25/005; F01D 5/20; F01D 11/02; F05D 2260/37; (Continued)

(56) References Cited

U.S. PATENT DOCUMENTS 5,653,581 A 8/1997 Dixon et al.
2012/0027572 A1 2/2012 Denece et al.
(Continued)

FOREIGN PATENT DOCUMENTS

EP 1 350 927 A2 10/2003
FR 2 955 898 A1 8/2011
(Continued)

OTHER PUBLICATIONS

Search Report as issued in French Patent Application No. 1657822, dated May 16, 2017.

*Primary Examiner* — Joseph J Dallo
*Assistant Examiner* — Scott A Reinbold
(74) *Attorney, Agent, or Firm* — Pillsbury Winthrop Shaw Pittman LLP

(57) ABSTRACT

A turbine ring assembly includes both a plurality of CMC ring sectors forming a turbine ring and a ring support structure, each ring sector having a portion forming an annular base that presents an outside face in the radial direction of the turbine ring, with first and second attachment tabs projecting therefrom in the radial direction, each attachment tab presenting an end that is free, each ring sector having third and fourth attachment tabs, each extending in the axial direction of the turbine ring between the free end of the first attachment tab and the free end of the second attachment tab. Each ring sector is fastened to the ring support structure by a bolt having a bolt head bearing against the ring support structure and a thread co-operating with tapping formed in a plate, the plate co-operating with the third and fourth attachment tabs.

10 Claims, 3 Drawing Sheets

(52) U.S. Cl.
CPC ..... *F05D 2220/32* (2013.01); *F05D 2240/11* (2013.01); *F05D 2240/14* (2013.01); *F05D 2260/37* (2013.01); *F05D 2300/6033* (2013.01)

(58) Field of Classification Search
CPC ..... F05D 2300/6033; F05D 2240/11; F05D 2220/32; F05D 2240/14
USPC ..... 415/173.1
See application file for complete search history.

(56) References Cited

U.S. PATENT DOCUMENTS

| | | | | |
|---|---|---|---|---|
| 2012/0082540 | A1* | 4/2012 | Dziech | F01D 11/005 415/173.1 |
| 2013/0156550 | A1* | 6/2013 | Franks | F01D 11/08 415/126 |
| 2013/0156556 | A1* | 6/2013 | Franks | F01D 25/246 415/182.1 |
| 2014/0271145 | A1 | 9/2014 | Thomas et al. | |
| 2016/0177759 | A1 | 6/2016 | Tuertscher et al. | |
| 2017/0114670 | A1* | 4/2017 | Shapiro | F01D 11/08 |
| 2018/0087400 | A1* | 3/2018 | Quennehen | F01D 11/08 |
| 2018/0087401 | A1* | 3/2018 | Quennehen | F01D 11/08 |
| 2018/0371948 | A1* | 12/2018 | Lepretre | F01D 25/246 |

FOREIGN PATENT DOCUMENTS

| | | | |
|---|---|---|---|
| GB | 2 480 766 | A | 11/2011 |
| WO | WO 2006/136755 | A2 | 12/2006 |
| WO | WO 2015/191174 | A1 | 12/2015 |

* cited by examiner

TURBINE RING ASSEMBLY

CROSS-REFERENCE TO RELATED APPLICATIONS

This application claims priority to French Patent Application No. 1657822, filed Aug. 19, 2016, the entire content of which is incorporated herein by reference in its entirety.

FIELD

The invention relates to a turbine ring assembly comprising a plurality of ring sectors made of ceramic matrix composite material, and it also relates to a ring support structure.

The field of application of the invention is in particular that of gas turbine aeroengines. Nevertheless, the invention is applicable to other turbine engines, e.g. industrial turbines.

BACKGROUND

For turbine ring assemblies that are made entirely out of metal, it is necessary to cool all of the elements of the assembly, and in particular the turbine ring since it is subjected to the hottest streams. This cooling has a significant impact on the performance of the engine since the cooling stream used is taken from the main stream passing through the engine. In addition, using metal for the turbine ring limits the potential for increasing temperature in the turbine, even though increasing temperature would make it possible to improve the performance of aeroengines.

In an attempt to solve those problems, turbine ring sectors have been envisaged that are made out of ceramic matrix composite (CMC) material in order to avoid using a metal material.

CMC materials present good mechanical properties that make them suitable for constituting structural elements, and advantageously they conserve these properties at high temperatures. Using CMC materials has advantageously made it possible to reduce the cooling stream needed in operation and thus to increase the performance of turbine engines. Furthermore, using CMC materials advantageously makes it possible to reduce the weight of turbine engines and to reduce the high temperature expansion effect that is encountered with metal parts.

Nevertheless, the existing solutions that have been proposed may involve assembling a CMC ring sector with metal attachment portions of a ring support structure, these attachment portions being subjected to the hot stream. Consequently, the metal attachment portions are subjected to expansion when hot, and that can lead to applying mechanical stresses to the CMC ring sectors and to causing them to be weakened.

Also known are the following documents, which disclose turbine ring assemblies: GB 2 480 766, EP 1 350 927, US 2014/0271145, US 2012/082540, and FR 2 955 898.

There exists a need to improve existing turbine ring assemblies making use of CMC material in order to reduce the magnitude of the mechanical stresses to which the CMC ring sectors are subjected while the turbine is in operation.

SUMMARY

An aspect of the invention seeks to propose a turbine ring assembly serving to hold each ring sector in deterministic manner, i.e. in such a manner as to control its position and prevent it from vibrating, while still enabling the ring sector, and by extension the ring, to deform under the effects of temperature rises and pressure variations, and to do so in particular independently of metal interface parts.

An embodiment of the invention provides a turbine ring assembly comprising both a plurality of ring sectors made of ceramic matrix composite material forming a turbine ring and also a ring support structure, each ring sector having a portion forming an annular base in a section plane defined by an axial direction and a radial direction of the turbine ring, the portion having an inside face in the radial direction of the turbine ring defining the inside face of the turbine ring, and an outside face from which there project in the radial direction of the turbine ring first and second attachment tabs, each presenting a first end secured to the outside face and a second end that is free, each ring sector having third and fourth attachment tabs, each extending in the axial direction of the turbine ring between the second end of the first attachment tab and the second end of the second attachment tab.

According to a general characteristic of the invention, each ring sector is fastened to the ring support structure by a fastener bolt having a bolt head bearing against the ring support structure and a thread co-operating with tapping made in a fastener plate, the fastener plate co-operating with the third and fourth attachment tabs.

Each ring sector is thus held at a single point in the radial direction of the turbine ring. Specifically, the single radial fastener point is defined by the assembly formed by the bolt and the fastener plate co-operating on one side with the ring support structure and on the other side with the first and second attachment tabs of the ring sector.

The above-defined solution for the ring assembly enables each ring sector to be held in deterministic manner, i.e. enables its position to be controlled and avoids it vibrating, while still allowing the ring sector, and by extension the ring, to deform under the effects of temperature and pressure, and in particular independently of metal interface parts.

In a first aspect of the turbine ring assembly, each ring sector may have at least two pegs arranged on either side of the fastener bolt and each presenting first and second ends, the first end of each peg being fastened to the ring support structure and the second end of each peg bearing against the ring sector.

The pegs extending between the ring support structure and the ring sector serve to prevent the ring sector from moving radially outwards, i.e. in a direction going away from the axis of revolution of the turbine ring. The pegs provide holding in a manner that is well adapted to the ring, thereby avoiding any need for clearance or clamping resulting from geometrical dispersion among the various parts.

In a variant of the first aspect of the turbine ring assembly, the ring assembly may include an annular spacer arranged between the ring and the ring support structure and comprising, for each ring sector, an orifice through which the fastener bolt passes, at least one first portion bearing in the radial direction against the ring support structure, and at least one second portion bearing in the radial direction against the ring sector, the annular spacer being a single part or being sectorized into a plurality of sectorized spacers.

The annular spacer may be in the form of an annular plate extending between the ring support structure and the ring and serving to block the ring sectors radially outwards, i.e. in a direction going away from the axis of revolution of the turbine ring. The annular spacer thus provides outward radial blocking as an alternative to the pegs, thereby reducing the number of parts used and avoiding making holes in the casing in order to insert the pegs.

In a second aspect of the turbine ring assembly, the fastener plate may have first and second mutually opposite ends in the circumferential direction of the turbine ring respectively in contact with the third and fourth attachment tabs, the first end having a first shoulder bearing against the third attachment tab, and the second end having a second shoulder bearing against the fourth attachment tab, and the first and second shoulders extending in the section plane defined by the axial direction and in the radial direction of the turbine ring.

The first and second shoulders of the fastener plate serve to provide abutments that prevent tangential rotation of the ring or of the ring sector about its axis.

In an embodiment, for each peg, at least a portion of the peg is positioned facing the first or second end of the fastener plate in order to have a portion of the third or fourth attachment tabs held vice-like between the fastener plate and the peg.

Approaching the pegs in this way to the bearing points between the fastener plate and the corresponding attachment tab serves to limit as much as possible the straightening effect. Additional stresses while hot are thus small.

In a variant, on each side of the fastener plate, the ring sector includes at least one bearing platform for the pegs arranged in the same plane as the plane of contact between the fastener plate and the third and fourth attachment tabs, the plane of contact being orthogonal to the planes in which the first and second shoulders extend.

Thus, bearing between the ring sector and the pegs, and also between the fastener plate and the ring sector, takes place in a single plane. When hot, even if the radius of a curve increases, a straight line remains straight. Under such circumstances, straightening effects are non-existent and there is no additional mechanical stress when hot. By using this solution, there is less need to be accurate when providing radial holding.

In a third aspect of the turbine ring assembly, the ring support structure may include first and second annular flanges, the first annular flange being upstream from the second annular flange relative to the intended air stream flow direction through the turbine ring assembly, and the first and second attachment tabs of each ring sector being held between the two annular flanges of the ring support structure, the second annular flange having a portion that is thinner than the remainder of the second annular flange, the thinner portion being arranged between a portion bearing against the second attachment tab and a portion of the junction with the remainder of the ring support structure.

The first and second annular flanges of the ring support structure serve to hold the position of the ring sector in the axial direction of the turbine ring.

Furthermore, reducing the thickness of the second annular flange, i.e. the downstream flange, makes it possible to provide the second flange with flexibility so as to avoid excessively stressing the ceramic matrix composite material of the ring sector.

It is also possible to establish axial prestress on the second annular flange by arranging for interference of a few tenths of a millimeter. This makes it possible to accommodate differences of expansion between elements made of ceramic matrix composite material and elements made of metal.

In a fourth aspect of the turbine ring assembly, the ring support structure may include first and second annular plates fastened to the first annular flange, the first and second annular plates thus being removable from the first annular flange, the first annular flange bearing against the first attachment tab and the second annular flange including a first end that is free and a second end that is coupled to the first annular plate, the first end being remote from the first annular plate in the axial direction of the turbine ring.

The removable nature of the first annular plate makes it possible to have axial access to the turbine ring cavity. This makes it possible to assemble the ring sectors together outside the ring support structure and then to slide the resulting assembly axially in the cavity of the ring support structure until it comes to bear against the second annular flange, prior to bolting each of the ring sectors to the ring support structure by means of the bolts and the fastener plate, and then fastening the first annular plate to the first annular flange.

During the operation of fastening the turbine ring to the ring support structure, it is possible to use a tool comprising firstly a cylinder or a ring having the ring sectors pressed thereagainst or held thereto by suction cups while they are being assembled to form a ring, and secondly a paddle for each of the fastener plates. Each paddle is configured to be inserted in the empty space between a pair of third and fourth attachment tabs and to hold the fastener plate pressed against the third and fourth attachment tabs before it is fastened to the ring support structure by the associated bolts.

The second annular plate is dedicated to taking up the force from the high pressure nozzle (HPN). This annular plate serves first to take up this force by deforming, and secondly to cause this force to pass towards the casing line that is mechanically the most robust.

In a fifth aspect of the turbine ring assembly, each ring sector may have rectilinear bearing surfaces mounted on the faces of the first and second attachment tabs respectively in contact with the second annular flange and with the first annular plate.

The rectilinear bearing surfaces serve to have sealing zones that are under control. More precisely, bearing against radial planes serves to avoid straightening forces in the turbine ring. This alignment of the contact zones on parallel rectilinear planes serves specifically to conserve lines of sealing in the event of the ring tilting and to conserve the same contact zones both when cold and when hot.

In operation, the ring sectors tilt about an axis corresponding to the normal to the plane formed between the axial direction and the radial direction of the turbine ring. In the event of curvilinear bearing, as in the prior art, the tabs of the ring sectors come into contact with the ring support structure via only one or two points, whereas in the present invention, the rectilinear bearing of the tabs of each ring sector provides bearing along an entire line, thereby improving sealing between the ring sectors and the ring support structure.

In a variant, for each ring sector, the faces of the second annular flange and of the first annular plate that are in contact respectively with the first and second attachment tabs include rectilinear bearing surfaces.

In an aspect of this variant, each rectilinear bearing surface may include a groove formed in the entire length of the bearing surface and a gasket inserted in the groove in order to improve sealing.

In a sixth aspect of the turbine ring assembly, the third and fourth attachment tabs each may be cut into two independent portions, each of the third and fourth attachment tabs having a first portion coupled to the first attachment tab and a second portion coupled to the second attachment tab.

Making each of the third and fourth attachment tabs in the form of two independent portions that are coupled respectively to the first and second attachment tabs enables the upstream and downstream portions of each ring sector, and thus of the turbine ring, to be mechanically dissociated so that they do not stress each other.

In a seventh aspect of the turbine ring assembly, the third and fourth attachment tabs are each coupled to the first and second attachment tabs respectively via first and second ends projecting in the radial direction of the turbine ring to extend the first and second attachment tabs so as to raise the third and fourth attachment tabs relative to the second ends of the first and second attachment tabs.

This difference in height between the third and fourth attachment tabs and the first and second attachment tabs of a ring sector enables a tool to be inserted under the fastener plate in order to hold the plate in position while fastening the bolts to the plate.

Another aspect of the invention also provides a turbine engine including a turbine ring assembly as defined above.

BRIEF DESCRIPTION OF THE DRAWINGS

The invention can be better understood on reading the following given by way of non-limiting indication and with reference to the accompanying drawings, in which.

DETAILED DESCRIPTION

Figure 1:
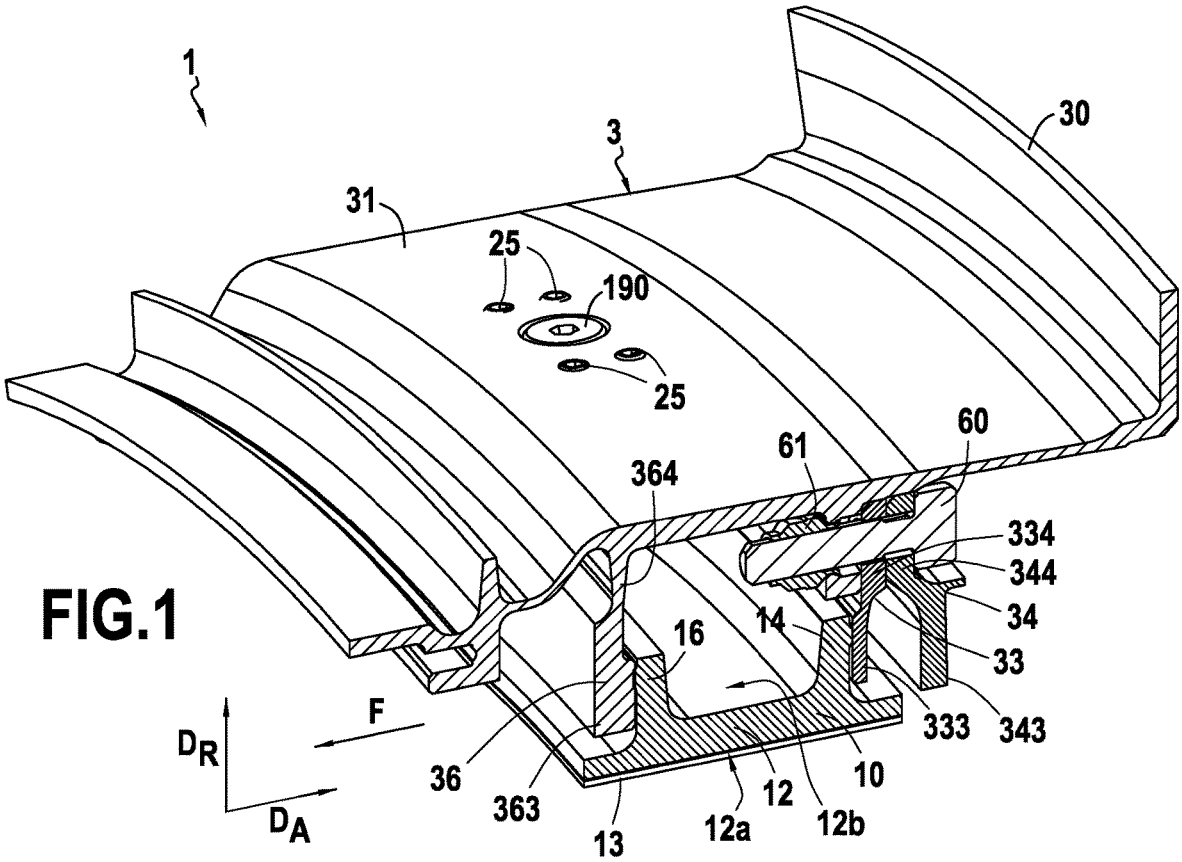
FIG. 1 is a first diagrammatic view in perspective of an embodiment of a turbine ring assembly of the invention.

FIG. 1 shows a high pressure turbine ring assembly comprising a turbine ring 1 made of ceramic matrix composite (CMC) material and a ring support structure 3 made of metal. The turbine ring 1 surrounds a set of rotary blades (not shown). The turbine ring 1 is made up of a plurality of ring sectors 10, FIG. 1 being a view in radial section. Arrow $D_A$ shows the axial direction of the turbine ring 1, whereas arrow $D_R$ shows the radial direction of the turbine ring 1. For reasons of simplifying the presentation, FIG. 1 is a fragmentary view of the turbine ring 1, which in reality constitutes a complete ring.

Figure 2:
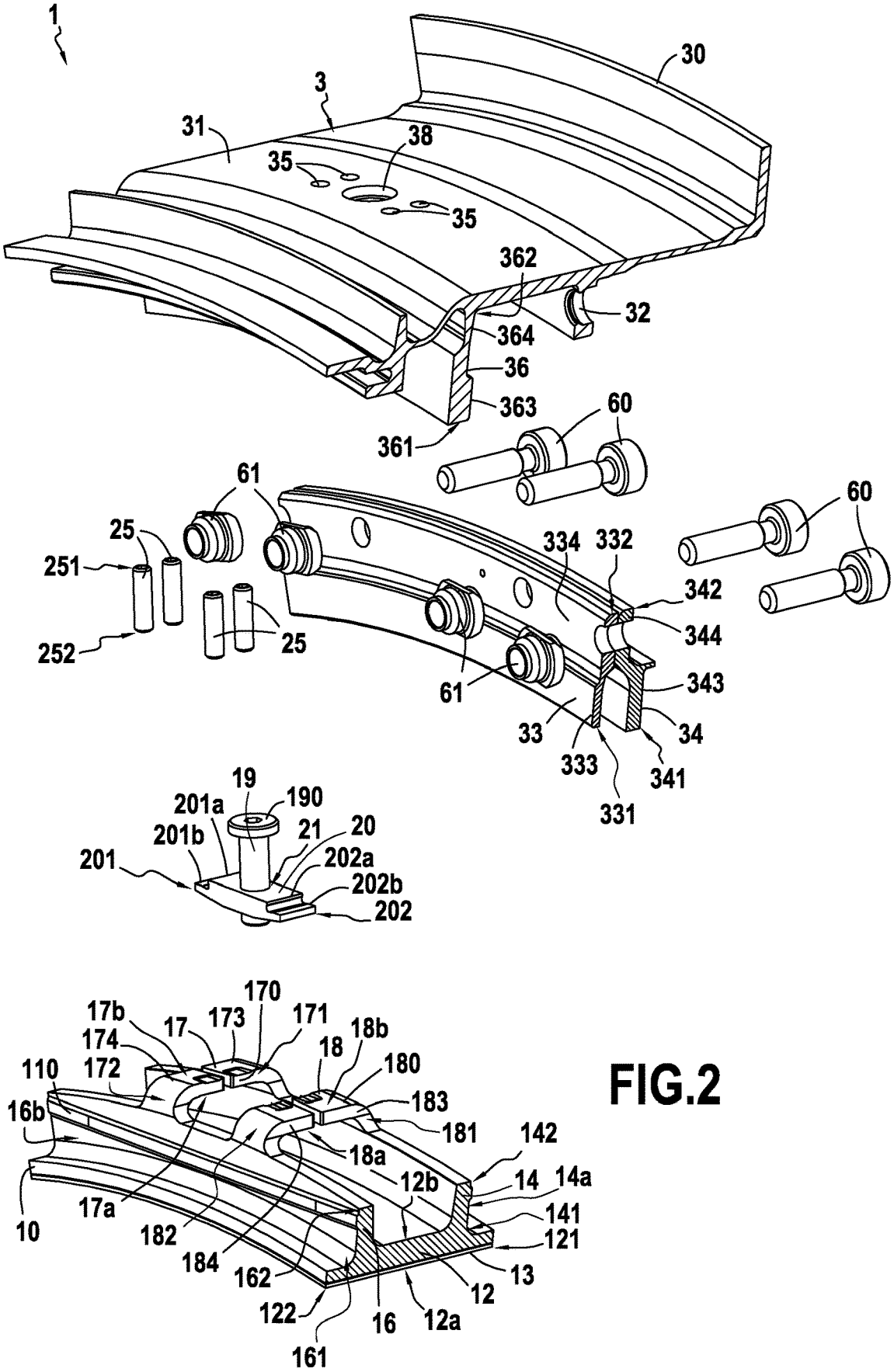
FIG. 2 is an exploded first diagrammatic view in perspective of the FIG. 1 turbine ring assembly.

As shown in FIG. 2, which is an exploded diagrammatic view in perspective of the FIG. 1 turbine ring assembly, each ring sector 10 presents a section in a plane defined by the axial and radial directions $D_A$ and $D_R$ that is substantially in the form of an upside-down Greek letter π. Specifically, the section has an annular base 12 and upstream and downstream radial attachment tabs 14 and 16. The terms "upstream" and "downstream" are used herein relative to the flow direction of the gas stream through the turbine, as represented by arrow F in FIG. 1.

In the radial direction $D_R$ of the ring 1, the annular base 12 has an inside face 12*a* and an outside face 12*b* that are opposite from each other. The inside face 12*a* of the annular base 12 is coated in a layer 13 of abradable material forming a thermal and environmental barrier and defining a flow passage for the gas stream through the turbine.

The upstream and downstream radial attachment tabs 14 and 16 project in the direction $D_R$ from the outside face 12*b* of the annular base 12 at a distance from the upstream and downstream ends 121 and 122 of the annular base 12. The upstream and downstream radial attachment tabs 14 and 16 extend over the entire width of the ring sector 10, i.e. over the entire circular arc described by the ring sector 10, or indeed over the entire circumferential length of the ring sector 10.

As shown in FIGS. 1 and 2, the ring support structure 3 that is secured to a turbine casing 30 comprises a central annulus 31 extending in the radial direction $D_A$ and having its axis of revolution coinciding with the axis of revolution of the turbine ring 1 when they are fastened together. The ring support structure 3 also comprises an upstream annular radial flange 32 and a downstream annular radial flange 36 that extend in the radial direction $D_R$ from the central ring 31 towards the center of the ring 1 and in the circumferential direction of the ring 1.

As shown in FIGS. 1 and 2, the downstream annular radial flange 36 has a first end 361 that is free and a second end 362 that is secured to the central annulus 31. The downstream annular radial flange 36 has a first portion 363 and a second portion 364. The first portion 363 extends between the first end 361 and the second portion 364, and the second portion 364 extends between the first portion 363 and the second end 364. The first portion 363 of the downstream annular radial flange 36 is in contact with the downstream radial attachment tab 16. The second portion 364 is thinner than the first portion 363 so as to give a certain amount of flexibility to the downstream annular radial flange 36, and thus avoid excessively stressing the CMC turbine ring 1.

Figure 3:
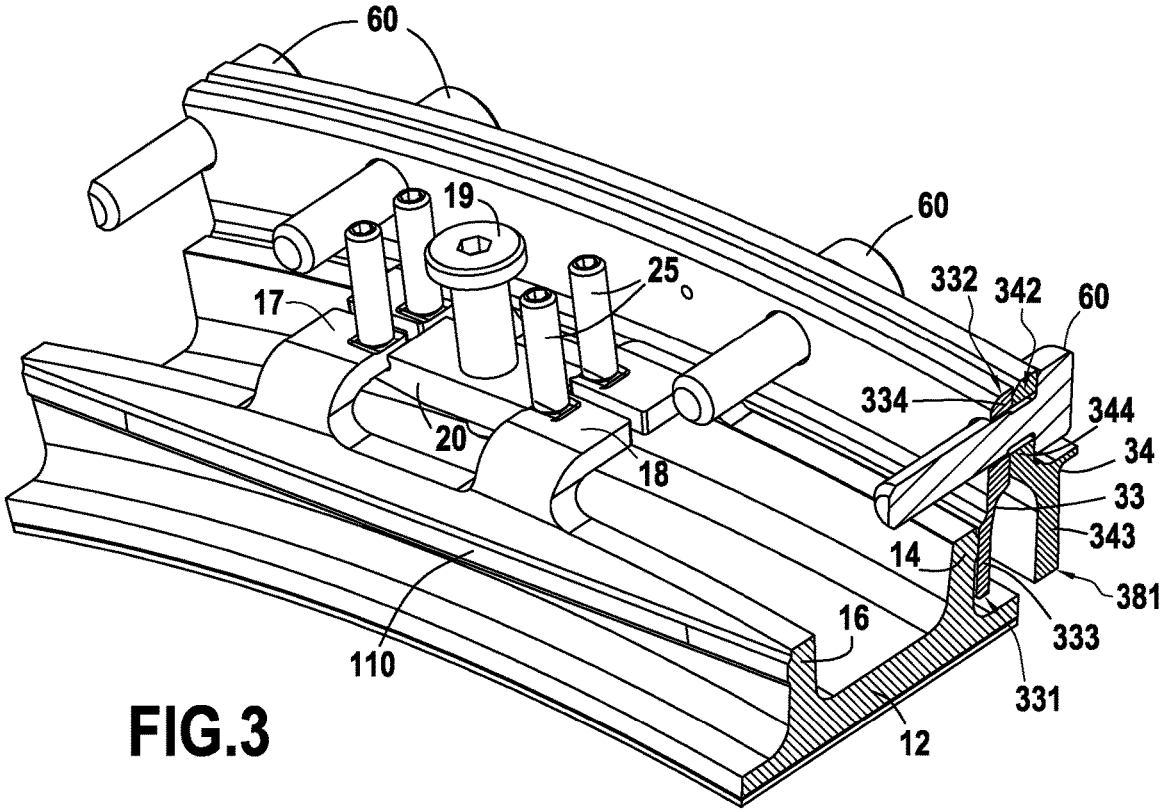
FIG. 3 is a second diagrammatic view in perspective of the FIG. 1 turbine ring assembly without a portion of the ring support structure.

As shown in FIGS. 1 and 2, and also in FIG. 3, which is a second diagrammatic view in perspective of the FIG. 1 turbine ring assembly 1 without a portion of the ring support structure 3, the ring support structure 3 further comprises first and second upstream plates 33 and 34 each in the form of a ring segment, the two upstream plates 33 and 34 being fastened together on the upstream annular radial flange 32.

The first upstream plate 33 has a first end portion 331 that is free and a second end portion 332 in contact with the central annulus 31, and also a first portion 333 and a second portion 334, the first portion 333 extending between the first end 331 and the second portion 334, and the second portion 334 extending between the first portion 333 and the second end 332.

The second upstream plate 34 comprises a first end 341 that is free and a second end 342 in contact with the central annulus 31, together with a first portion 343 and a second portion 344, the first portion 343 extending between the first end 341 and the second portion 344, and the second portion 344 extending between the first portion 343 and the second end 342.

The first portion 333 of the first upstream plate 33 bears against the upstream radial attachment tab 14 of the ring sector 10. The first and second upstream plates 33 and 34 are shaped so as to have the first portions 333 and 343 spaced apart from each other and the second portions 334 and 344 in contact, both plates 33 and 34 being releasably fastened on the upstream annular radial flange 32 by means of fastener bolts 60 and nuts 61, the bolts 60 passing through the second portions 334 and 344 of the upstream plates 33 and 34, and also through the upstream annular radial flange 32.

The second upstream plate 34 is dedicated firstly to taking up force from the high pressure nozzle (HPN) by deforming, and secondly to causing that force to pass towards the casing line that is the most robust mechanically.

In the axial direction $D_A$, the downstream annular radial flange 36 of the ring support structure 3 is separated from the first upstream plate 33 by a distance corresponding to the spacing between the upstream and downstream radial attachment tabs 14 and 16 so as to keep them between the downstream annular radial flange 36 and the first upstream plate 33.

Figure 4:
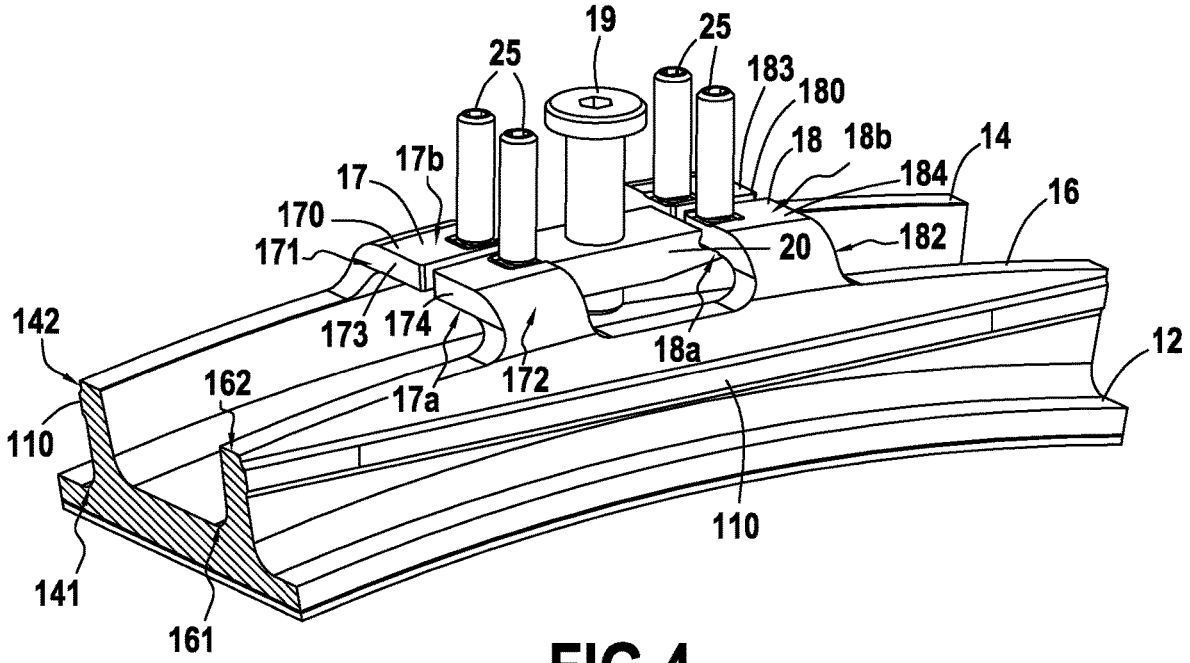
FIG. 4 is a third diagrammatic view in perspective of the FIG. 1 turbine ring assembly without the ring support structure.

As shown in FIGS. 2 and 3, and also in FIG. 4, which is a third diagrammatic view in perspective of the FIG. 1 turbine ring assembly 1 without the ring support structure 3, the annular sector 10 has two axial attachment tabs 17 and 18 extending between the upstream and downstream radial attachment tabs 14 and 16.

Each of the upstream and downstream radial attachment tabs 14 and 16 has a first end 141, 161 secured to the outside face 12*b* of the annular base 12 and a second end 142, 162 that is free. The axial attachment tabs 17 and 18 extend more precisely in the axial direction $D_A$ between the second end 142 of the upstream radial attachment tab 14 and the second end 162 of the downstream radial attachment tab 16.

Each of the axial attachment tabs 17 and 18 has a respective upstream end 171, 181 and a respective downstream end 172, 182, the pair of ends 171 & 172 or 181 & 182 of axial attachment tab 17 or 18 being separated by a central portion 170 or 180. The upstream and downstream ends 171, 172 or 181, 182 of each axial attachment tab 17 or 18 project in the radial direction $D_R$ from the second end 142, 162 of the radial attachment tab 14, 16 to which they are coupled, so as to have a central portion 170 or 180 of the axial attachment tab 17 or 18 that is raised relative to the second end 142, 162 of the upstream and downstream radial attachment tabs 14, 16.

In the embodiment shown in FIGS. 1 to 4, each of the axial attachment tabs 17 and 18 is cut in two, forming respective upstream portions 173 and 183 and downstream portions 174 and 184.

As shown in FIGS. 2 to 4, for each ring sector 10, the turbine ring assembly has a bolt 19 and a fastener plate 20. The fastener plate 20 has first and second ends 201 and 202 bearing respectively against the first and second axial attachment tabs 17 and 18.

Each of the first and second ends 201 and 202 of the fastener plate 20 includes a cutout forming a first abutment, respectively 201*a* and 202*a* against rotation, i.e. an abutment in a direction orthogonal to the section plane containing the axial direction $D_A$ and the radial direction $D_R$, and a second radial abutment, respectively 201*b* and 202*b* forming more particularly an abutment in the radial direction $D_R$ in the direction going towards the center of the ring 1. The cutout in each end 201 and 202 thus co-operates with a distinct axial attachment tab 17 or 18 in order to bear against both sides simultaneously of the same edge face of the axial attachment tab 17 or 18.

The fastener plate 20 thus provides radial retention for the gas flow passage by exerting a radial force via the two radial abutments 201*b* and 202*b* bearing against the inside faces 17*a* and 18*a* in the radial direction $D_R$ of the two axial attachment tabs 17 and 18. By means of the two axial attachment tabs 17 and 18, each bearing against an opposite side of the fastener plate 20, the fastener plate 20 also prevents the ring sector 10 and thus the ring 1 from making any movement in rotation about the axis of the turbine 1.

The fastener plate 20 also has an orifice 21 that is tapped for co-operating with a thread of the bolt 19 so as to fasten the fastener plate 20 to the bolt 19. The bolt 19 has a head 190 of diameter greater than the diameter of an orifice 38 formed in the central annulus 31 of the ring support structure 3 through which the bolt 19 is inserted prior to being screwed into the fastener plate 20.

The ring sector 10 is secured radially with the ring support structure 3 by means of the bolt 19, with its head 190 bearing against the central annulus 31 of the ring support structure 3, and with the fastener plate 20 having the bolt 19 screwed therein and having its ends 201 and 202 bearing against the axial attachment tabs 17 and 18 of the ring sector 10, the bolt head 190 and the ends 201 and 202 of the fastener plate exerting forces in opposite directions in order to hold together the ring 1 and the ring support structure 3.

In order to prevent the ring sector 10 moving radially in a direction opposite to the direction of the forces exerted by the second abutments 201*b* and 202*b* at the ends 201 and 202 of the fastener plate 20 against the axial attachment tabs 17 and 18, the turbine ring assembly in this embodiment has four pegs 25 extending in the radial direction $D_R$ between the central annulus 31 of the ring support structure 3 and the axial attachment tabs 17 and 18 of the ring 1. More precisely, the pegs 25 have first ends 251 inserted by force into orifices 35 formed in the central annulus 31 around the orifice 38 receiving the fastener bolt 19. In a variant, the pegs could equally well be engaged as an interference fit in the orifices 35 by known metal fixtures such as H6-P6 fittings or by putting the pegs into contact with a cold fluid (e.g. nitrogen) prior to installing them, or else they may be held in the orifices by screw fastening, in which case the pegs 25 have threads that co-operate with tapping made in the orifices 35.

The four pegs 25 are distributed symmetrically relative to the bolt 19 so as to have two pegs 25 extending between the first axial attachment tab 17 and the ring support structure 3, and two pegs 25 extending between the second axial attachment tab 18 and the ring support structure 3. The pegs 25 are dimensioned and installed so that a second end 252 of each peg 25, opposite from its first end 251, comes to bear against the associated axial attachment tab 17 or 18, more particularly against the corresponding outside face 17*b* or 18*b*, thereby using the fastener plate 20 to prevent the axial attachment tabs 17 and 18, and thus the ring 1, from moving radially either way along the radial direction $D_R$ of the ring 1.

Each ring sector 10 also has rectilinear bearing surfaces 110 on the faces of the upstream and downstream radial attachment tabs 14 and 16 that are respectively in contact with the first upstream annular plate 33 and the downstream annular radial flange 36, i.e. against the upstream face 14*a* of the upstream radial attachment tab 14 and against the downstream face 16*b* of the downstream radial attachment tab 16. In a variant, the rectilinear bearing surfaces could be provided on the first upstream annular plate 33 and on the downstream annular radial flange 36.

The rectilinear bearing surfaces 110 serve to have controlled sealing zones. Specifically, the bearing surfaces 110 between the upstream radial attachment tab 14 and the first upstream annular plate 33 and also between the downstream radial attachment tab 16 and the downstream annular radial flange 36 are contained in a common rectilinear plane. Thus, when hot, there is no straightening effect in the turbine ring 1 as can occur with curvilinear bearing between the ring sectors and the ring support structure.

There follows a description of a method of making a turbine ring assembly corresponding to the assembly shown in FIG. 1.

Each above-described ring sector 10 is made of ceramic matrix composite (CMC) material by forming a fiber preform having a shape close to that of the ring sector and by densifying the ring sector with a ceramic matrix.

In order to make the fiber preform, it is possible to use ceramic fiber yarns, e.g. yarns made of SiC fibers such as those sold by the Japanese supplier Nippon Carbon under the name "Hi-NicalonS", or yarns made of carbon fibers.

The fiber preform is beneficially made by three-dimensional weaving, or multilayer weaving, with zones of non-interlinking being provided in order to be able to separate preform portions that correspond to the tabs 14 and 16 of the sectors 10.

The weaving may be of the interlock type. Other three-dimensional or multilayer weaves could be used, such as for example multi-plain or multi-satin weaves. Reference may be made to Document WO 2006/136755.

After weaving, the blank may be shaped in order to obtain a ring sector preform that is consolidated and densified by a ceramic matrix, it being possible in particular to perform the densification by chemical vapor infiltration (CVI), as is well known. In a variant, the textile preform may be hardened a little by CVI so that it becomes sufficiently rigid to enable it to be handled, prior to causing liquid silicon to be taken up in the textile by capillarity in order to perform densification ("melt infiltration").

A detailed example of fabricating CMC ring sectors is described in particular in Document US 2012/0027572.

The ring support structure 3 is made of a metal material such as a Waspaloy® or Inconel 718® or C263® alloy.

The making of the turbine ring assembly then continues by mounting the ring sectors 10 on the ring support structure 3.

To do this, the ring sectors 10 are assembled on an annular tool of the "spider" type, e.g. having suction cups, each configured to hold a ring sector 10. Thereafter, the fastener plates 20 are inserted in each of the empty spaces extending between first and second axial attachment tabs 17 and 18 of a ring sector 10. Until it has been screwed to the ring support structure 3, each fastener plate 20 is held in position bearing against the axial attachment tabs 17 and 18 of the associated ring sector by means of a holder tab mounted on the annular tool. The annular tool includes one holder tab for each fastener plate 20, i.e. for each ring sector 10. Each holder tab is inserted between the two axial attachment tabs 17 and 18 of a ring sector 10 and also between the second end 162 of the downstream radial attachment tab 16 and the fastener plate 20. Each holder tab is then adjusted to hold the associated fastener plate 20 bearing against the axial attachment tabs 17 and 18. Each fastener bolt 19 is then inserted in the associated orifice 38 of the central annulus of the ring support structure 3 and screwed into the tapped hole 21 of the associated fastener plate 20 until the bolt head 190 bears against the central annulus 31, and the pegs 25 with their first ends 251 inserted by force in the orifices 35 coming into contact with the axial attachment tabs 17 and 18 so that the associated ring sector 10 is held radially. The first and second plates 33 and 34 are then fastened to the downstream annular radial flange 32 using bolts 60 and nuts 61 so as to hold the turbine ring 1 axially, after which the annular tool is withdrawn.

The invention thus provides a turbine ring assembly enabling each ring sector to be held in a deterministic manner while still allowing the ring sector, and by extension the ring, to deform under the effect of temperature and pressure, and in particular to do so independently of the metal interface parts.

The invention claimed is:

1. A turbine ring assembly comprising:

a plurality of ring sectors made of ceramic matrix composite material forming a turbine ring;

a ring support structure, each ring sector having a portion forming an annular base in a section plane defined by an axial direction and a radial direction of the turbine ring, said portion having an inside face in the radial direction of the turbine ring defining the inside face of the turbine ring, and an outside face from which there project in the radial direction of the turbine ring a first attachment tab and a second attachment tab, each presenting a first end secured to the outside face and a second end that is free, wherein each ring sector has a third attachment tab and a fourth attachment tab, each extending in the axial direction of the turbine ring between the second end of the first attachment tab and the second end of the second attachment tab, and wherein each ring sector is fastened to the ring support structure by a fastener bolt having a bolt head bearing against the ring support structure and a thread co-operating with a tapping made in a fastener plate, the fastener plate co-operating with the third and fourth attachment tabs, the third attachment tab and the fourth attachment tab each being cut into two independent portions, each of the third and fourth attachment tabs having a first portion coupled to the first attachment tab and a second portion coupled to the second attachment tab.

2. The assembly according to claim 1, wherein each ring sector has at least two pegs arranged on either side of said fastener bolt and each presenting first and second ends, the first end of each peg being fastened to the ring support structure and the second end of each peg bearing against the ring sector.

3. The assembly according to claim 1, further comprising an annular spacer arranged between the ring and the ring support structure and comprising, for each ring sector, an orifice through which the fastener bolt passes, at least one first portion bearing in the radial direction against the ring support structure, and at least one second portion bearing in the radial direction against the ring sector, the annular spacer being a single part or being sectorized into a plurality of sectorized spacers.

4. The assembly according to claim 1, wherein the fastener plate has first and second mutually opposite ends in the circumferential direction respectively in contact with the third and fourth attachment tabs, the first end having a first shoulder bearing against the third attachment tab, and the second end having a second shoulder bearing against the fourth attachment tab, and the first and second shoulders each extending in the axial direction and in the radial direction of the turbine ring.

5. The assembly according to claim 1, wherein the ring support structure includes a first annular flange and a second annular flange, the first annular flange being upstream from the second annular flange relative to the intended air stream flow direction through the turbine ring assembly, and the first and second attachment tabs of each ring sector being held between the first and second annular flanges of the ring support structure, the second annular flange having a portion that is thinner than the remainder of the second annular flange, the thinner portion being arranged between a portion bearing against the second attachment tab and one end of the second annular flange secured to the remainder of the ring support structure.

6. The assembly according to claim 5, wherein the ring support structure comprises a removable first annular plate fastened to the first annular flange and bearing against the first attachment tab, and a second annular plate having a first end that is free and a second end coupled to the first annular flange and to the first annular plate, the first end being remote from the first annular plate in the axial direction of the turbine ring.

7. The assembly according to claim 5, wherein each ring sector has rectilinear bearing surfaces mounted on the faces of the first and second attachment tabs respectively in contact with the second annular flange and with the first annular plate.

8. The assembly according to claim 5, wherein, for each ring sector, the faces of the second annular flange and of the first annular plate that are in contact respectively with the first and second attachment tabs include rectilinear bearing surfaces.

9. The assembly according to claim 1, wherein the third and fourth attachment tabs are each coupled to the first and second attachment tabs respectively via first and second ends projecting in the radial direction of the turbine ring to extend the first and second attachment tabs so as to raise the third and fourth attachment tabs relative to the second ends of the first and second attachment tabs.

10. A turbine engine including a turbine ring assembly according to claim 1.

* * * * *